US011408197B2

(12) United States Patent
Chen

(10) Patent No.: US 11,408,197 B2
(45) Date of Patent: Aug. 9, 2022

(54) LOCK

(71) Applicant: Jeff Chen, Chiayi County (TW)

(72) Inventor: Jeff Chen, Chiayi County (TW)

( * ) Notice: Subject to any disclaimer, the term of this patent is extended or adjusted under 35 U.S.C. 154(b) by 256 days.

(21) Appl. No.: 16/877,496

(22) Filed: May 19, 2020

(65) Prior Publication Data

US 2021/0363783 A1 Nov. 25, 2021

(51) Int. Cl.
*E05B 9/00* (2006.01)
*E05B 9/02* (2006.01)
*E05B 9/08* (2006.01)

(52) U.S. Cl.
CPC ..... *E05B 9/08* (2013.01); *E05B 9/002* (2013.01); *E05B 9/02* (2013.01); *E05Y 2900/132* (2013.01)

(58) Field of Classification Search
CPC ... E05B 9/08; E05B 9/002; E05B 9/02; E05B 3/06; E05B 63/10; E05B 9/004; E05B 9/006; E05Y 2900/132
USPC ..... 292/1.5, 347, 348, 349, DIG. 53, 292/DIG. 54, DIG. 64
See application file for complete search history.

(56) References Cited

U.S. PATENT DOCUMENTS 6,223,572 B1 * 5/2001 Marttinen ..... E05B 63/10 292/357
6,681,605 B1 * 1/2004 Huang ..... E05B 55/005 292/DIG. 60
8,449,005 B1 * 5/2013 Wang ..... E05B 63/16 292/336.3

* cited by examiner

*Primary Examiner* — Kristina R Fulton
*Assistant Examiner* — Thomas L Neubauer
(74) *Attorney, Agent, or Firm* — Raymond Chan

(57) ABSTRACT

A lock, adapted for being assembled on a door panel, is provided. The door sheet has an assembling hole and a latch slot connected and communicated with the assembling hole. The lock includes a latch assembly, a first locking mechanism, and a second locking mechanism. The latch assembly is assembled in the latch slot and extended into the assembling hole. The first locking mechanism and the second locking mechanism are assembled in the assembling hole from the two sides thereof respectively to automatically position and affix the latch assembly. Because the latch assembly can be to led to move and positioned in the latch slot and the assembling hole by the first locking mechanism and no screw or other tool are required for fastening in the entire process of the assembling, the present invention is therefore easy and convenient to assemble.

6 Claims, 12 Drawing Sheets

LOCK

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a lock, and, in particular, to a lock to be assembled from the outer side, inner side, and lateral side of a door panel at the same time.

Description of Related Arts

There are various types of lock in the market, such as Taiwan Pat. Nos. 83208619 and 101207351 and U.S. patent application Ser. Nos. 11/059,765 and 09/392,525, and so on. The disclosed structures of the locks are often utilized for regular door household locks, in which a user is allowed to lock or open the lock through using a key from outside of the door or turning the lock from inside of the door. In addition, technology revealed by Taiwan Pat. No. 108206360 is often utilized in locks of the above mentioned purposes.

Referring to FIG. 1, a perspective view of a conventional lock assembled on a door is illustrated. A conventional lock 1 (i.e. a lock having the same or even different structure to the above mentioned prior arts) basically and essentially includes an inner locking member 11, an outer locking member 12, and a bolt 13. The inner locking member 11 and the outer locking member 12 are opposite assembled and coupled with each other respectively from the inside and outside of the door panel 14. The bolt 13 is assembled between the inner locking member 11 and the outer locking member 12 through the lateral side of the door panel 14. A face plate 131 of the bolt 13 has to be fastened on the door panel 14 through two screws 15. The consumer has to buy a lock 1 of this type and assemble it by himself or herself at home with a simple screw driver in most cases. That is, the user has to manually utilize the screw driver to drive the screws 15 into the door panel 14 so as to fasten the face plate 131. Hence, there is a drawback in troublesome of assembling. Besides, when the user has to replace the lock 1 that new screws 15 have to be screwed into the old screw holes, the new screws 15 could consequently fail to be fully fastened in some cases and render the face plate 131 failing to be fully fastened on the lateral side of the door panel 14, which can therefore affect the positioning of the bolt 13 and greatly lower the assembling quality of the lock 1.

SUMMARY OF THE PRESENT INVENTION

Hence, an object of the present invention is to provide a lock that is easy to assemble and install without any screw or other tool being required for fastening and assembling.

Accordingly, the lock of the present invention is assembled on a door panel. The door panel has a first surface, a second surface, a lateral side, an assembling hole passing through the first surface and the second surface, and a latch slot concavely arranged on the lateral side. The latch slot is communicated with the assembling hole. The lock comprises a latch assembly, a first locking mechanism and a second locking mechanism. The latch assembly is assembled in the latch slot and extended into the assembling hole. The latch assembly includes a face member, an assembly base connected with the face member, an assembly body extended from the assembly base, and a latch linked to the assembly body and adapted to be driven to move thereby. The assembly body has a core lock hole provided at the center thereof and an engaging hole. When the latch assembly is assembled on the door panel, the face member is allowed to lean against the lateral side of the door panel, the assembly base is arranged in the latch slot, and the assembly body is correspondingly arranged in the assembling hole. The first locking mechanism is assembled in the assembling hole through and from the first surface of the door panel and includes a first locating barrel arranged in the assembling hole, a locating ring assembled on the exterior of the first locating barrel, a linkage member assembled on the center of the locating ring, and a first locating pin arranged on the locating ring. The first locating barrel allows the assembly body to pass therethrough. The linkage member is adapted for passing through the core lock hole of the assembly body to link and drive the assembly body to act. The first locating pin is adapted for passing through the first locating barrel and the engaging hole of the assembly body and has a first engaging wedge side slantly formed and defined on an edge thereof. When the first locating pin is inserted further into the engaging hole, the first engaging wedge side engages and leans on the hole edge of the engaging hole and links and drives the latch assembly to move inward the assembling hole, so as to push the face member to lean against the lateral side of the door panel. The second locking mechanism is assembled on the second surface of the door panel. The second locking mechanism includes a second locating barrel inserted into the assembling hole and coupled with the first locating barrel and a turning member assembled on the exterior of the second locating barrel. The turning member is also connected with the linkage member, so as to allow the linkage member to link and drive the assembly body to act when the turning member or the linkage member is turned. According to the present invention, when the first locking mechanism and the second locking mechanism are assembled with the latch assembly of the lock, the latch assembly can be brought to position automatically by the first locking mechanism in the latch slot and the assembling hole and no screw or other tool are required for fastening in the process of the assembling. Hence, the present invention is easy and convenient to assemble.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
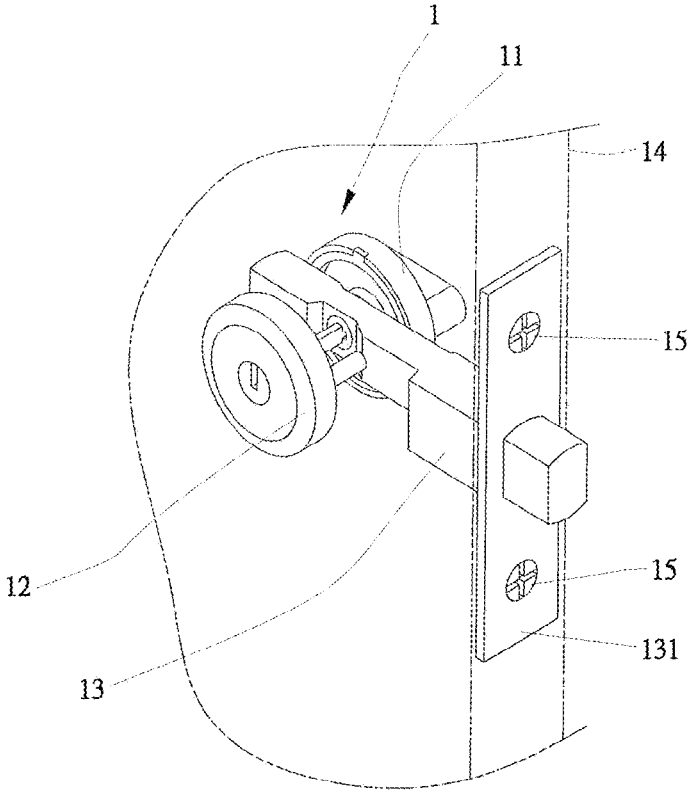
FIG. 1 PRIOR ART
FIG. 1 is a perspective view of a conventional lock assembled on a door panel.
Figure 2:
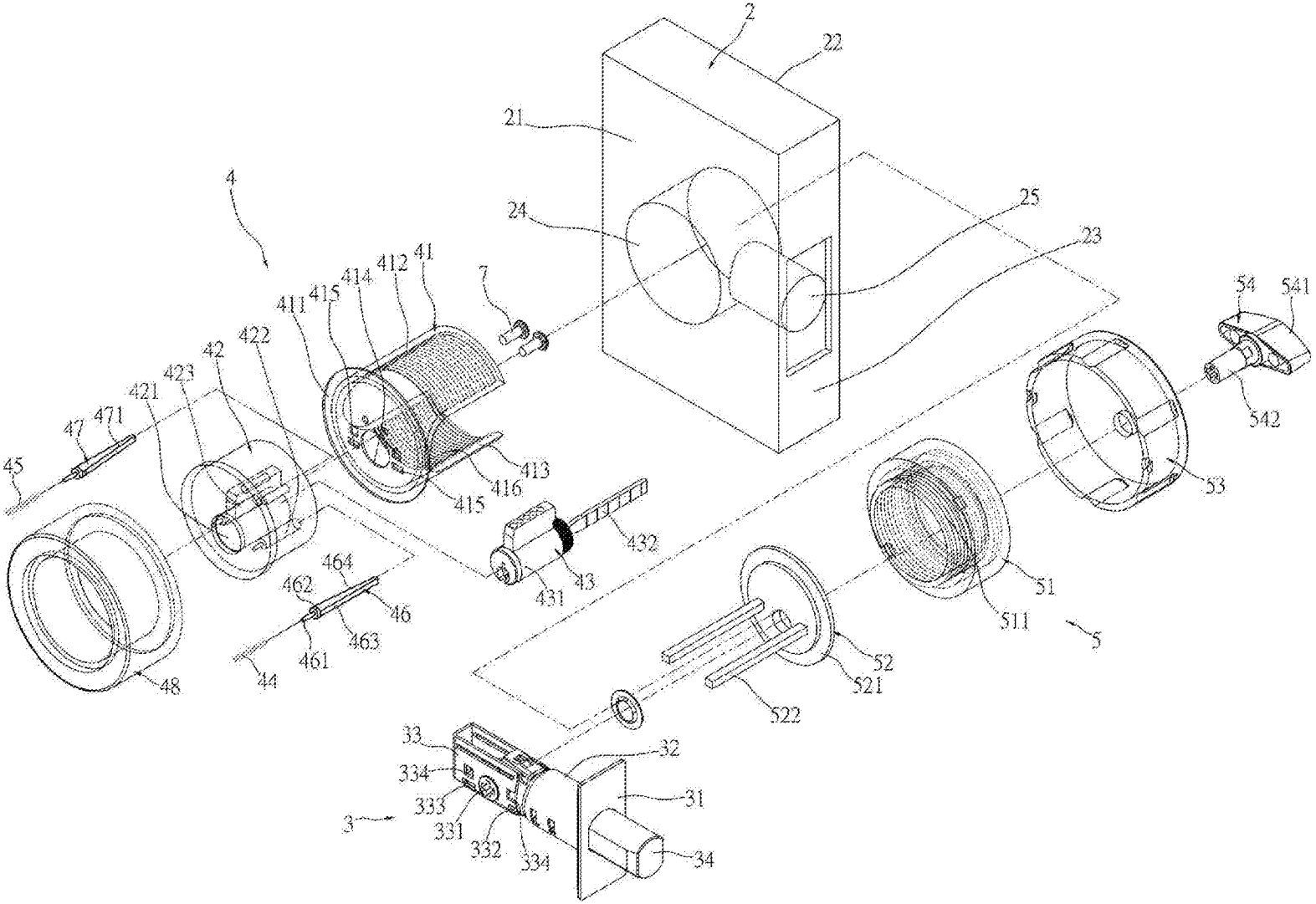
FIG. 2 is an exploded view of a lock according to a preferred embodiment of the present invention and a door panel.
Figure 3:
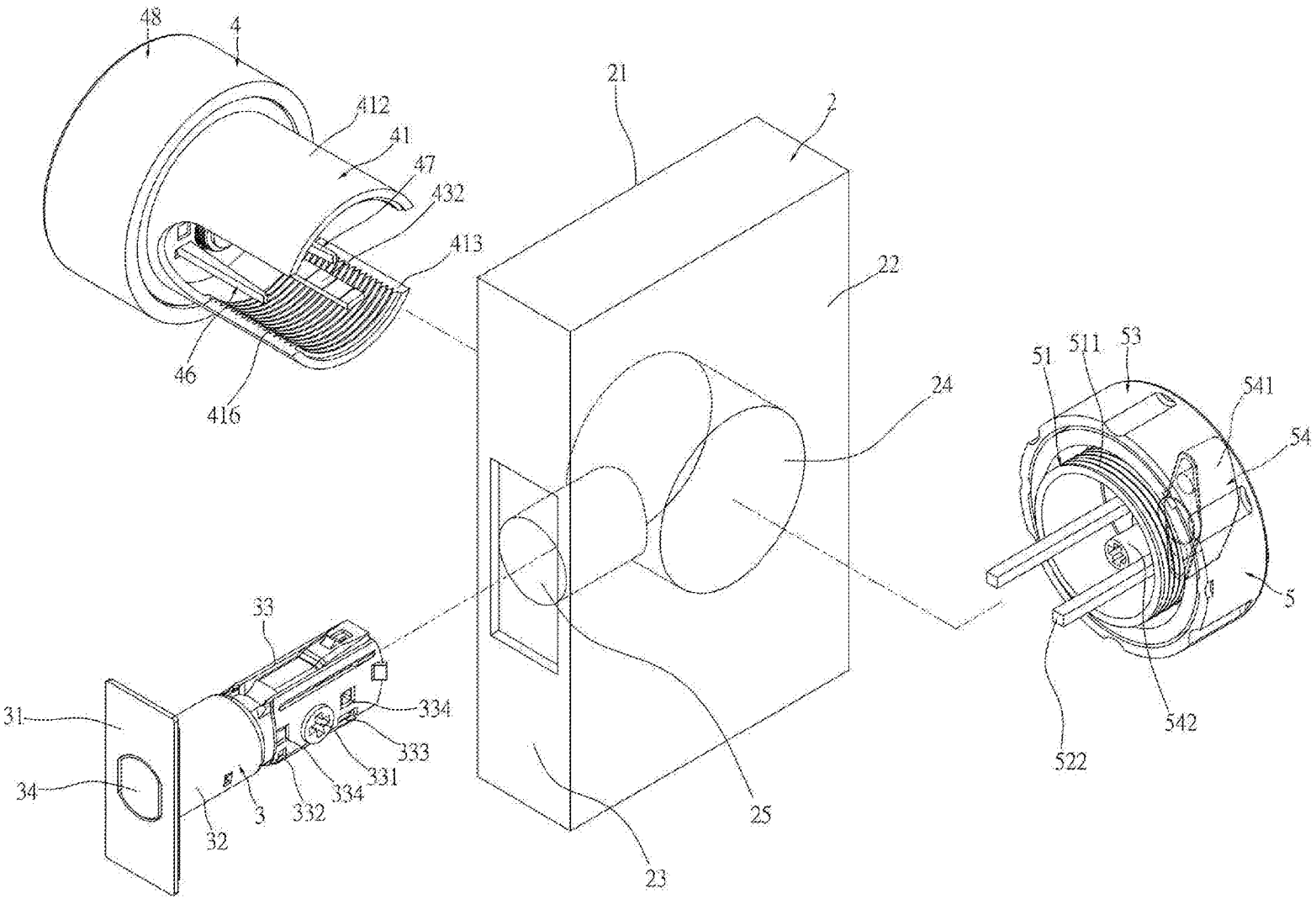
FIG. 3 is a partially exploded view of the lock according to the above preferred embodiment of the present invention and a door panel.
Figure 4:
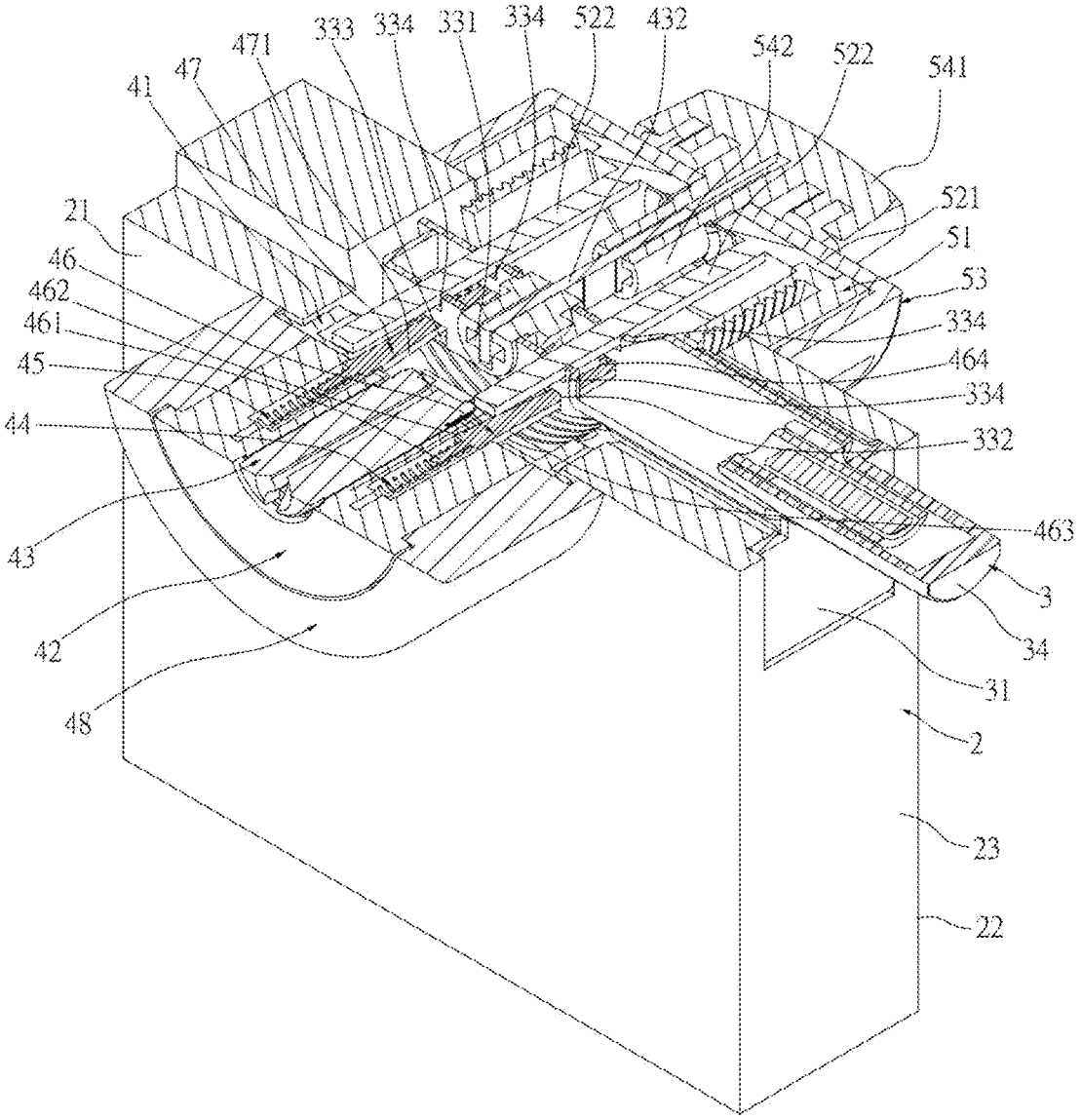
FIG. 4 is a sectional view of the lock according to the above preferred embodiment of the present invention assembled on a door panel.
Figure 5:
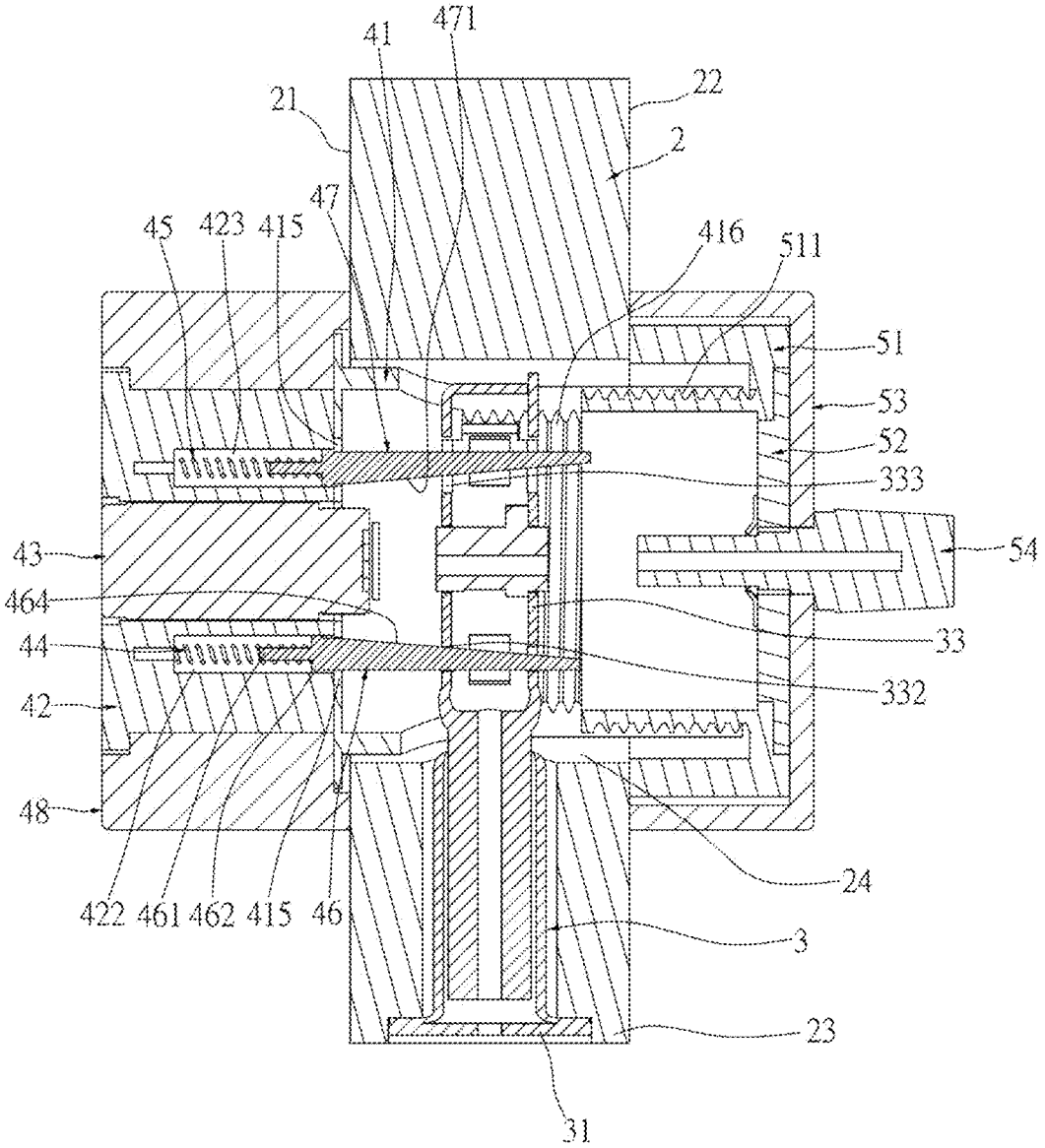
FIG. 5 is a top sectional view of the lock according to the above preferred embodiment of the present invention assembled on a door panel.

Referring to FIGS. 2-6, the lock according to a preferred embodiment of the present invention is assembled on a door panel 2, so as to allow the door panel 2 to be locked or set into position. The door panel 2 has a first surface 21, a second surface 22, a lateral side 23, an assembling hole 24 passing through the first surface 21 and the second surface 22, and a latch slot 25 concavely formed in the lateral side 23. The first surface 21 and the second surface 22 are also called and defined as the outer side and the inner side respectively according to the present embodiment. The latch slot 25 is communicated with the assembling hole 24. The lock comprises a latch assembly 3, a first locking mechanism 4 and a second locking mechanism 5.

The latch assembly 3 is mostly assembled in the latch slot 25 through the lateral side 23 of the door panel 2 and extended into the assembling hole 24. The latch assembly 3 comprises a face member 31, an assembly base 32 connected with the face member 31, an assembly body 33 extended from the assembly base 32, and a latch 34 drivenably linked with the assembly body 33. When the latch assembly 3 is assembled in the door panel 2, the face member 31 is capable of leaning and attaching on the lateral side 23 of the door panel 2. The assembly base 32 is arranged in the latch slot 25. The assembly body 33 is correspondingly arranged in the assembling hole 24. The assembly body 33 has a core lock hole 331 provided at the center thereof, an engaging hole 332, a passage hole 333, and two perforations 334, wherein the engaging hole 332, the passage hole 333 and the two perforations 334 are arranged passing through the assembly body 33 and arranged around the core lock hole 331. The engaging hole 332 and the passage hole 333 are positioned below the core lock hole 331 and are arranged corresponding to each other. The perforations 334 are arranged above the core lock hole 331 and corresponding to each other. The mechanism regarding how the assembly body 33 links and drives the latch 34 to operate is similar to that of the Taiwan Pat. No. 108206360 that is not repetitively described here.

The first locking mechanism 4 is assembled in the assembling hole 24 through the first surface 21 of the door panel 2 and comprises a first locating barrel 41 configured for inserting and assembling in the assembling hole 24, a locating ring 42 assembled on an outer side of the first locating barrel 41, a linkage member 43 assembled on the locating ring 42, a first resilient member 44, a second resilient member 45, a first locating pin 46, a second locating pin 47, and a hollow exterior housing 48 sleeved on the locating ring 42, wherein the first resilient member 44, the second resilient member, the first locating pin 46 and the second locating pin 47 are arranged in the locating ring 42. The first locating barrel 41 comprises a base plate 411 provided for being contacted and attached with the first surface 21 of the door panel 2. The first locating barrel 41 further comprises an upper barrel piece 412 and a lower barrel piece 413 respectively extended from the base plate 411 toward the assembling hole 24. The base plate 411 has a docking hole 414 provided therein in correspondence to the core lock hole 331 and four through holes 415 provided therein in correspondence to the engaging hole 332, the passage hole 333, and the two perforations 334 respectively. The upper barrel piece 412 and the lower barrel piece 413 define a space therebetween for the assembly body 33 to laterally pass through and to be accommodated therein. Besides, each of the upper barrel piece 412 and the lower barrel piece 413 have an internal thread 416 provided thereon. The locating ring 42 has a connecting hole 421 formed at a center thereof for the linkage member 43 to be assembled therein, and a first accommodating slot 422 and a second accommodating slot 423 bilaterally symmetrically provided thereon around the connecting hole 421. The first resilient member 44 and the first locating pin 46 are both assembled in the first accommodating slot 422, while the second resilient member 45 and the second locating pin 47 are both assembled in the second accommodating slot 423. The first resilient member 44 and the second resilient member 45 are respectively adapted to resiliently and timely push the first locating pin 46 and the second locating pin 47. The first locating pin 46 has a small axial portion 461 provided coaxially for inserting into the first resilient member 44, a big axial portion 462 extended and boringly expanded from the small axial portion 461, and an intersecting axial portion 463 extended and boringly shrank from the big axial portion 462. An outer diameter of the big axial portion 462 is larger than the bore of the corresponding through hole 415. The intersecting axial portion 463 is adapted for inserting into the corresponding through hole 415 of the first locating barrel 41 and the engaging hole 332 of the assembly body 33. Also, the intersecting axial portion 463 has a first engaging wedge side 464 slantly formed and defined on an edge thereof. When the first locating pin 46 is inserted further into the engaging hole 332, the first engaging wedge side 464 engages and leans on the hole edge of the engaging hole 332, such that the first locating pin 46 provides a cushioning function and is capable of linking and driving the latch assembly 3 to move inward and toward the latch slot 25 and the assembling hole 24 because of the pushing force of the first resilient member 44. Therefore, the face member 31 would lean against the lateral side 23 of the door panel 2. The second locating pin 47 is adapted to pass through the passage hole 333 without contacting the edge of the passage hole 333. The structure of the second locating pin 47 is similar to that of the first locating pin 46 and thus not being repetitively specified here. Nevertheless, the second engaging wedge side 471 of the second locating pin 47 is correspondingly facing the first engaging wedge side 464.

Figure 6:
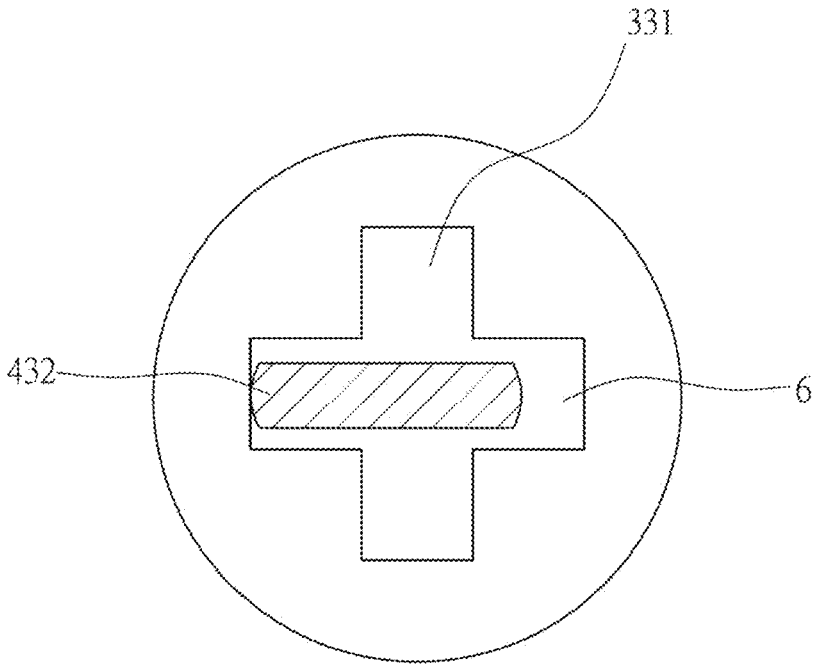
FIG. 6 is a sectional view of a stem assembled in a core lock hole according to the above preferred embodiment of the present invention.

The type of the linkage member 43 may vary depending on the function of the lock. For example, it may be a turnable part, so as only for linking and driving the assembly body 33 and the latch 34 to act and operate. Nonetheless, if the linkage member 43 has a function of locking/unlocking with a key, as illustrated in the present embodiment, the linkage member 43 may have to be a key cylinder, which has a core locking portion 431 assembled in the connecting hole 421 of the locating ring 42 and a stem 432 extended from the core locking portion 431. The stem 432 passes through the core lock hole 331 of the latch assembly 3 and is capable of linking and driving the assembly body 33 to act and operate, wherein a suitable gap 6 is remained to be formed therebetween, as illustrated in FIG. 6.

The process to assemble the first locking mechanism 4 includes that:

assembling the locating ring 42 on the outer side of the exterior housing 48, assembling the core locking portion 431 of the linkage member 43 into the connecting hole 421, sequentially assembling the first resilient member 44 and the first locating pin 46 into the first accommodating slot 422, sequentially assembling the second resilient member 45 and the second locating pin 47 into the second accommodating slot 423, coupling the docking hole 414 of the base plate 411 with the core locking portion 431, correspondingly inserting the first locating pin 46 and the second locating pin 47 into the through holes 415 of the base plate 411, and affixing the base plate 411 with the locating ring 42 through two rivet joint member 7.

At this point, the big axial portion 462 of the first locating pin 46 is unable to pass through the through hole 415, such that it will not escape from the first accommodating slot 422, so as the second locating pin 47. Hence, the first locking mechanism 4 is assembled.

The second locking mechanism 5, which is assembled on the second surface 22 of the door panel 2, comprises a second locating barrel 51 inserted into the assembling hole 24 and connected with the first locating barrel 41, a mounting member 52 assembled in the second locating barrel 51, a cover 53 covered on the outer side of the second locating barrel 51, and a turning member 54 arranged outside of the cover 53. The second locating barrel 51 has an external thread 511 provided thereon and adapted for being screwed and coupled with the internal thread 416 of the first locating barrel 41. The mounting member 52 comprises a disk 521 pivotally arranged in the second locating barrel 51 and two mounting rods 522 parallelly extended from the disk 521. The mounting rods 522 correspondingly and respectively pass through the perforations 334 of the assembly body 33 so as to enhance the stability of the assembling of the latch assembly 3. The turning member 54 comprises a knob 541 and a shank 542 extended from the knob 541 and passing through the cover 53, the second locating barrel 51, and the disk 521. The shank 542 is connected with the stem 432, such that as the knob 541 is turned, the assembly body 33 will be linked and driven to act and operate through the shank 542 and the stem 432.

A process to assemble the second locking mechanism 5 mainly includes:

affixing and arranging the second locating barrel 51 in the cover 53, pivotally arranging the disk 521 of the mounting member 52 in the second locating barrel 51, and pivotally arranging the shank 542 of the turning member with the cover 53, the second locating barrel 51, and the disk 521, such that the second locking mechanism 5 is assembled.

Figure 7:
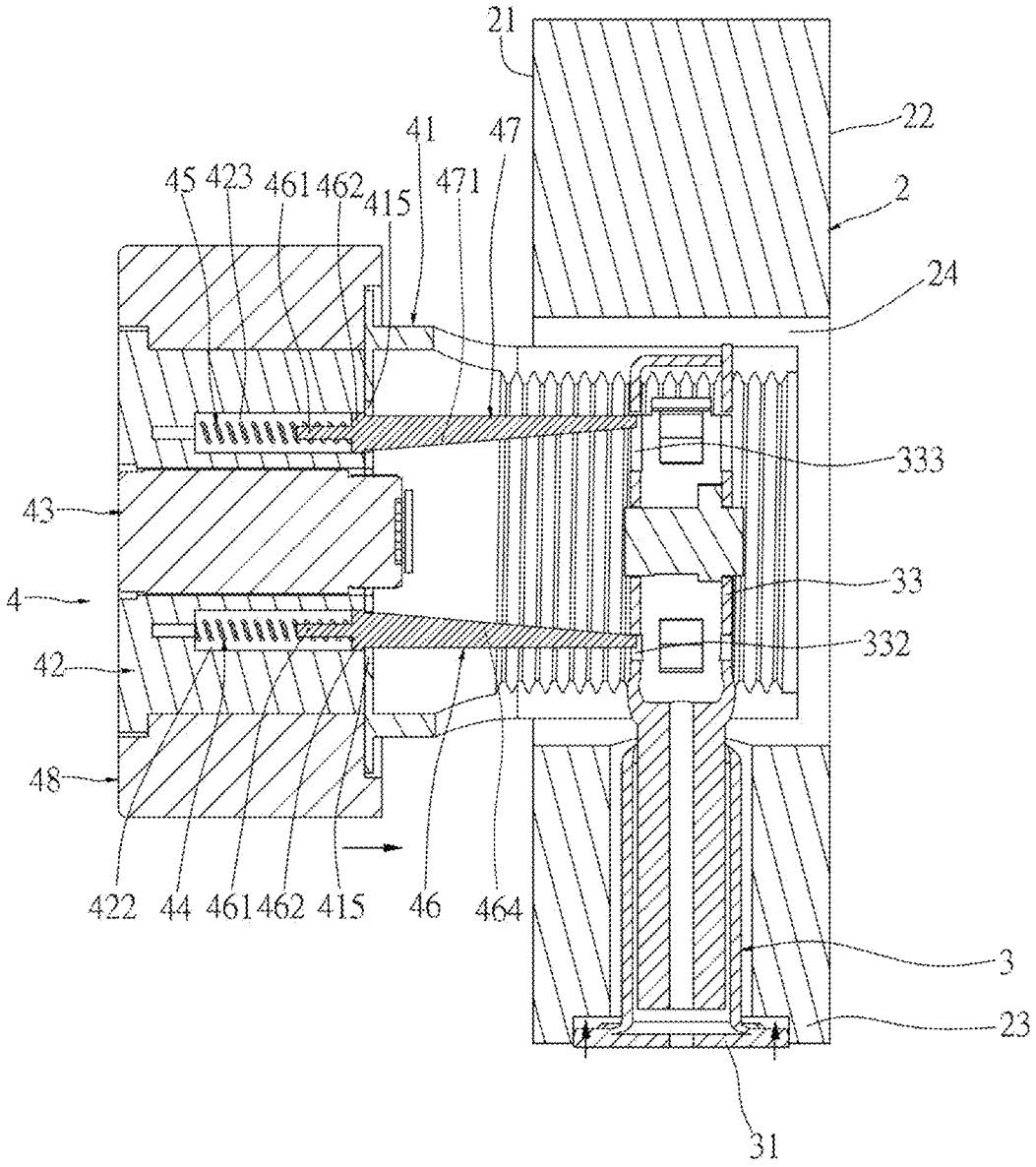
FIG. 7 is a top sectional view of the lock in assembling according to the above preferred embodiment of the present invention.
Figure 8:
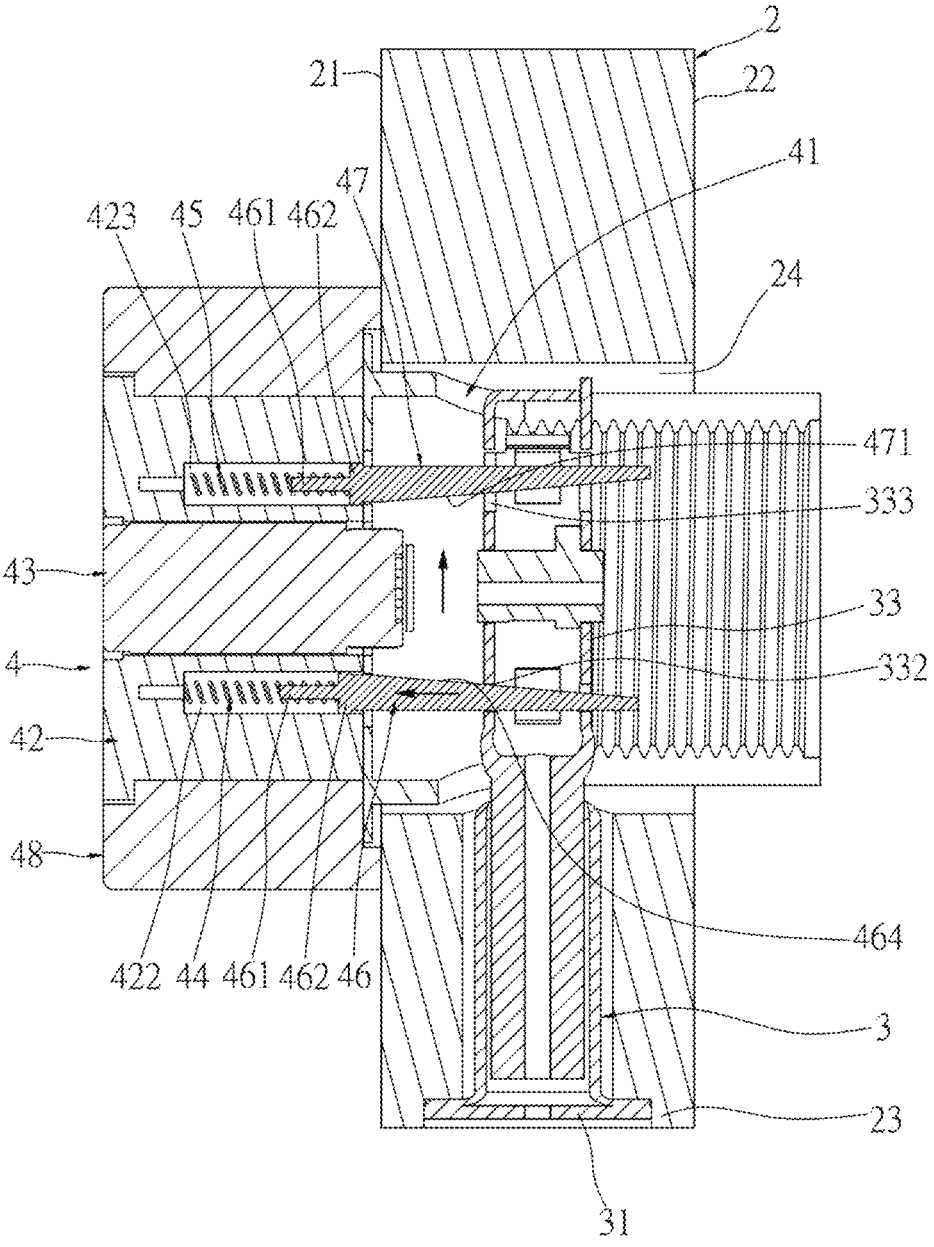
FIG. 8 is a top sectional view of the lock in assembling continuing from FIG. 7 according to the above preferred embodiment of the present invention.
Figure 9:
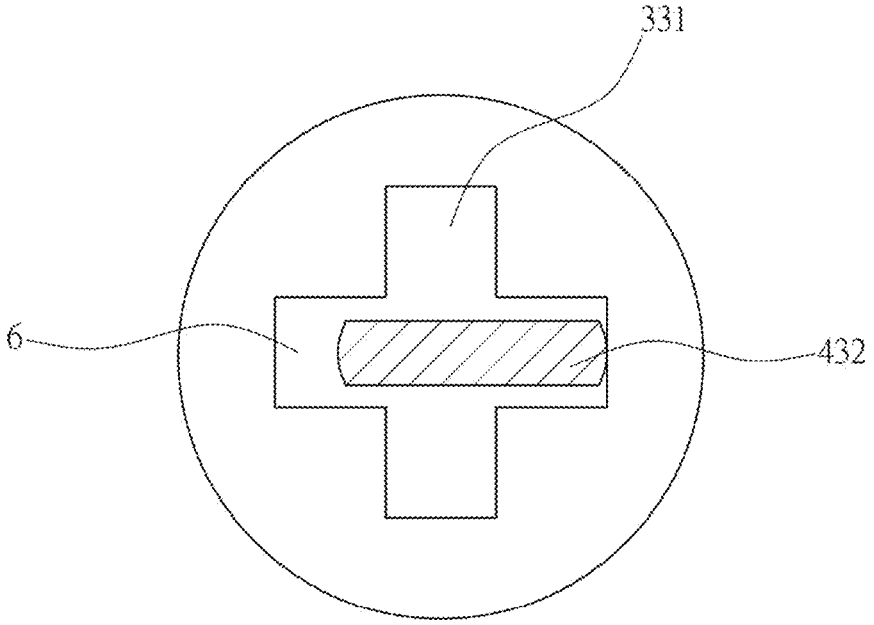
FIG. 9 is a sectional view of a stem being moved relatively to the position of the core lock hole according to the above preferred embodiment of the present invention.
Figure 10:
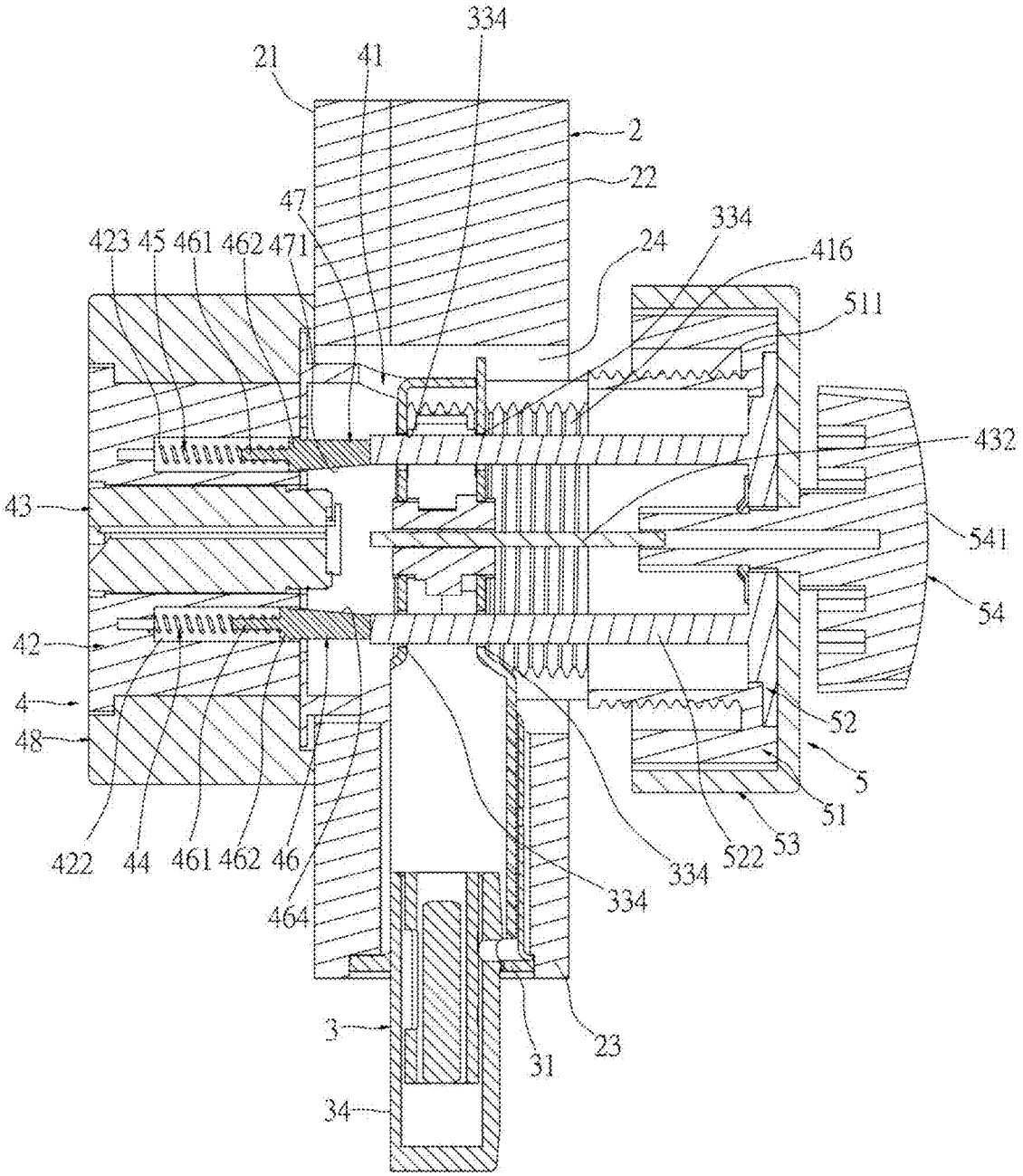
FIG. 10 is another top sectional view of the lock in assembling according to the above preferred embodiment of the present invention.
Figure 11:
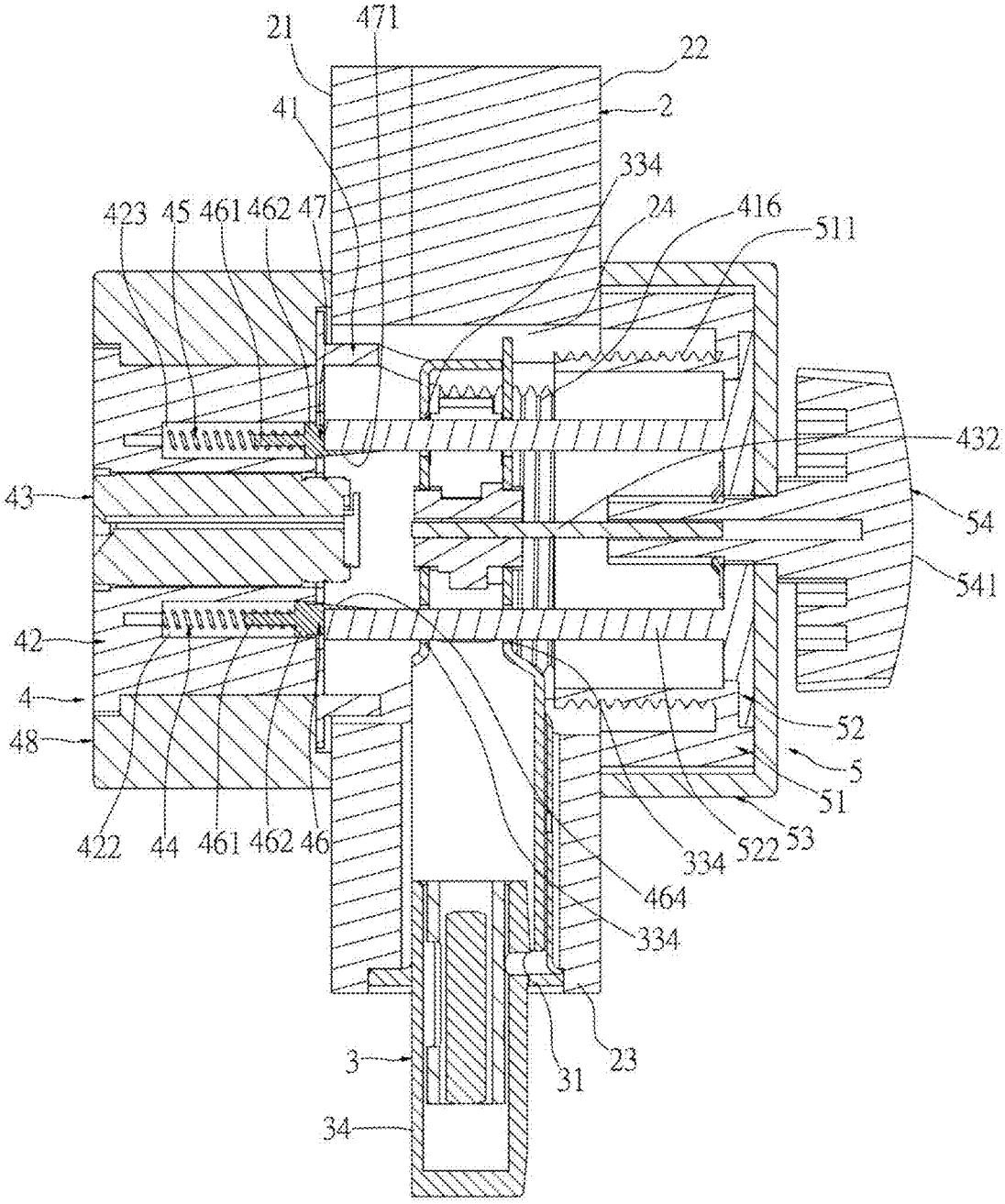
FIG. 11 is a top sectional view of the lock in assembling continuing from FIG. 10 according to the above preferred embodiment of the present invention.

Referring to FIG. 11, a process to correspondingly assemble the lock onto the door panel 2 includes the following steps. First, the latch assembly 3 is assembled into the latch slot 25 and the assembling hole 24 of the door panel 2. Then, as illustrated in FIG. 7, the first locating barrel 41 of the completely assembled first locking mechanism 4 is inserted into the assembling hole 24 from the first surface 21 of the door panel 2 and the first locating pin 46 and the second locating pin 47 respectively pass through the engaging hole 332 and the passage hole 333. At this point, as the first locating barrel 41 is inserted further into the assembling hole 24, the first engaging wedge side 464 of the first locating pin 46 would engage and lean on the hole edge of the engaging hole 332, which will push the entire latch assembly 3 to move inward. When the first locking mechanism 4 is engaged and positioned with the door panel 2, as illustrated in FIG. 8, the latch assembly 3 is linked and driven to properly shift as the arrow indicated. Besides, the face member 31 is just attached on and leaned against the lateral side 23 of the door panel 2. At this point, the stem 432 also shifts relatively to the core lock hole 331, as illustrated in FIG. 9. Next, the second locking mechanism 5 is assembled into the assembling hole 24 from the second surface 22 of the door panel 2. The mounting rods 522 are first correspondingly inserted into the perforations 334, as illustrated in FIG. 10. Then, the cover 53 is turned, so as to have the external thread 511 of the second locating barrel 51 screwed and coupled with the internal thread 416 of the first locating barrel 41 and eventually contact the second surface 22, as illustrated in FIG. 11, such that the lock is assembled on the door panel 2.

During the assembling of the lock of the present invention, the first resilient member 44 can push the first locating pin 46 to laterally shift the latch assembly 3 to position and eventually have the face member 31 lean against the lateral side 23 of the door panel 2. That is the resilience pushing of the first resilient member 44 provide a cushioning function for the assembling between the first locating pin 46 and the latch assembly 3, which not only enhances the assembling adaptability between the two and avoids poor assembling due to structural and dimensional tolerances, but also allows the lock of the present invention to maintain the face member 31 of the latch assembly 3 fitting and leaning on the lateral side 23 of the door panel 2 even for door sheets 2 of various thicknesses. In addition, it is worth mentioning that, because the latch assembly 3 of the lock of the present invention is laterally movable during the assembling process, a gap 6 is provided between the stem 432 of the linkage member 43 and the core lock hole 331 of the latch assembly 3 to allow the latch assembly 3 to have sufficient shifting space.

The lock of the present invention is mainly formed by the first locking mechanism 4, the latch assembly 3, and the second locking mechanism 5. Because the first locking mechanism 4 and the second locking mechanism 5 can be screwed to connect with each other and the latch assembly 3 can be brought to position by the first locking mechanism 4 automatically in the latch slot 25 and the assembling hole 24, therefore no screw or other tool are required for fastening in the process of the assembling. Accordingly, the present invention is easy and convenient to assemble. In addition, the first locating barrel 41 and the second locating barrel 51 can be screwed to be coupled with each other and the first resilient member 44 has a cushioning function that resiliently pushing the first locating pin 46 to laterally position the latch assembly 3, so that when a thickness of the door panel 2 has changed in a certain extent, the lock is still capable of functioning. Hence, the lock of the present invention is not only easy and convenient to assemble, but also widely suitable for various types and thicknesses of the door panel 2 in the market, which is, in other words, better in applicability.

Figure 12:
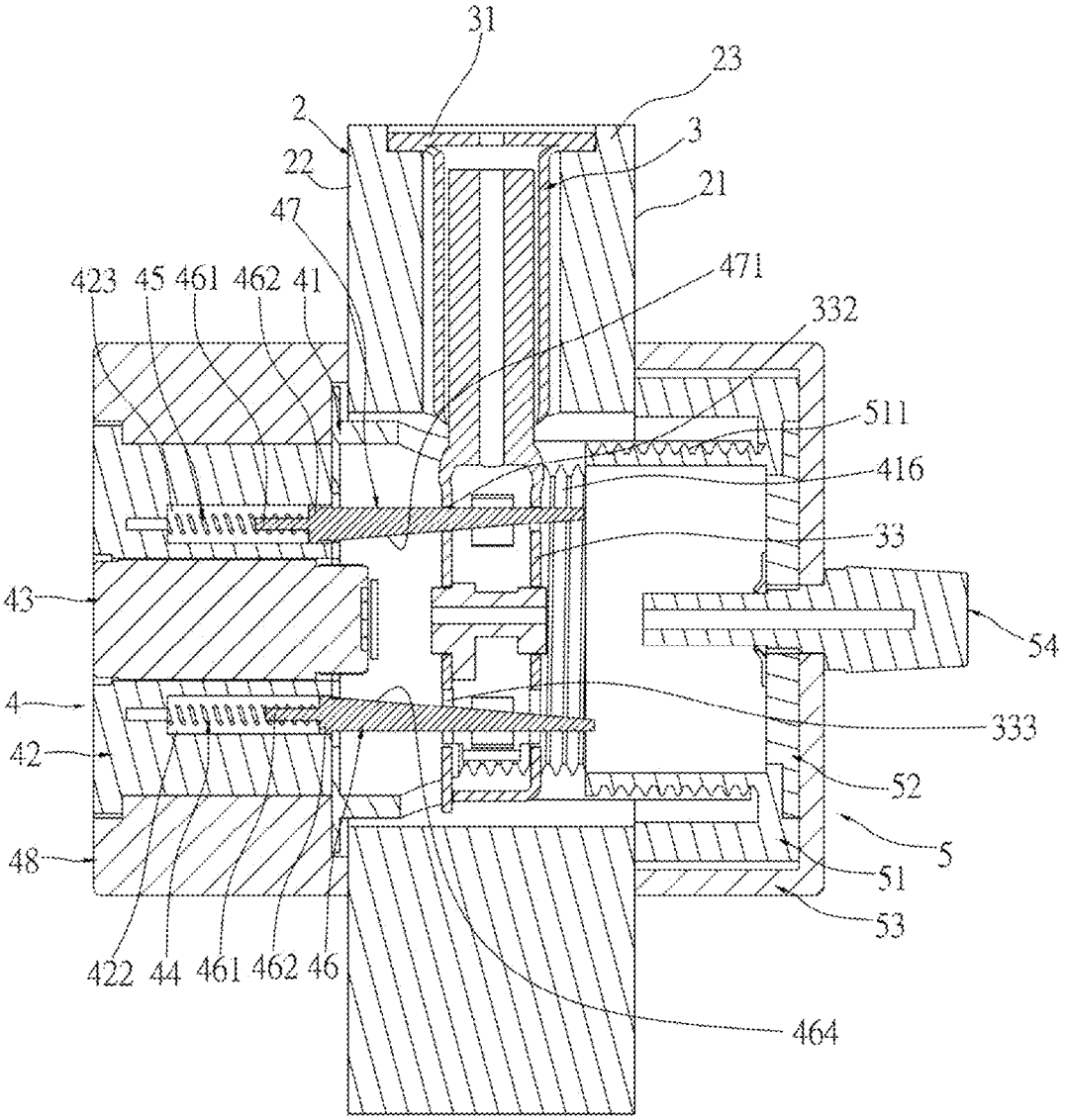
FIG. 12 is a top sectional view of a latch assembly of the lock being reversely assembled on a door panel according to the above preferred embodiment of the present invention assembled on a door panel.

The lock according to the present invention may also be utilized in a door panel 2 of a different open direction (e.g. left hand, right hand, and etc.). Referring to FIG. 12, when the door panel 2 has an opposite open direction, it only has to reversely assemble the latch assembly 3 in the door panel 2 and does not have to change the assembling position of the first locking mechanism 4 and the second locking mechanism 5 at all. In this case, the second locating pin 47 of the first locking mechanism 4 is inserted and arranged in the engaging hole 332 and the second engaging wedge side 471 contacts and leans against the hole edge of the engaging hole 332 to link and drive the latch assembly 3 to withdraw, so as to allow the face member 31 to lean against the lateral side 23 of the door panel 2, which is also capable of driving the latch assembly 3 to laterally position. Hence, the design and arrangement of the second locating pin 47 of the lock of the present invention can further enhance the applicability of a lock.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lock, adapted for being assembled on a door panel having a first surface, a second surface, a lateral side, an assembling hole passing through the first surface and the second surface, and a latch slot which is concavely arranged on the lateral side and communicated with the assembling hole, wherein said lock comprises:

a latch assembly, adapted for being assembled in the latch slot and extended into the assembling hole, comprising a face member, an assembly base connected with said face member, an assembly body extended from said assembly base, and a latch drivenably linked with said assembly body, wherein said assembly body has a core lock hole at a center thereof and an engaging hole, whereby when said latch assembly is assembled on the door panel, said face plate is configured to be attached on the lateral side of the door panel, said assembly base is arranged in the latch slot, and said assembly body is correspondingly arranged in the assembling hole;

a first locking mechanism, adapted for being assembled in the assembling hole from the first surface of the door panel, comprising a first locating barrel configured for being arranged in the assembling hole, a locating ring assembled on an exterior of said first locating barrel, a linkage member assembled on a center of said locating ring, and a first locating pin arranged on said locating ring, wherein said first locating barrel allows said assembly body to pass therethrough and said linkage member passes through said core lock hole of said assembly body to link and drive said assembly body to act and operate, wherein said first locating pin passes through said first locating barrel and said engaging hole of said assembly body and has a first engaging wedge side slantly formed and defined on an edge thereof, wherein when said first locating pin is inserted further into said engaging hole, said first engaging wedge side engages and leans on a hole edge of said engaging hole and links and drives said latch assembly to move inwardly in the assembling hole, so as to push said face member for leaning against the lateral side of the door panel; and a second locking mechanism, configured for being assembled on the second surface of the door panel, comprising a second locating barrel adapted for inserting into the assembling hole and coupled with said first locating barrel and a turning member assembled on an exterior of said second locating barrel, wherein said turning member is also connected with said linkage member, so as to allow said linkage member to link and drive said assembly body to act and operate when one of said turning member and said linkage member is turned.

2. The lock, as recited in claim 1, wherein said locating ring has a first accommodating slot provided therein, wherein said first locking mechanism further comprises a first resilient member assembled in said first accommodating slot, wherein said first locating pin is slidably arranged into said first accommodating slot to be pushed against said first resilient member, such that said first engaging wedge side of said first locating pin leans against the hole edge of said engaging hole.

3. The lock, as recited in claim 2, wherein said assembly body further has a passage hole therein, aligning to and corresponding to said engaging hole, wherein said first locking mechanism further comprises a second locating pin and a second resilient member, wherein said second locating pin has a second engaging wedge side and said locating ring further has a second accommodating slot bilaterally symmetrical to said first accommodating slot, wherein said second resilient member and said second locating pin are also assembled in said second accommodating slot, wherein said second locating pin slidably passes through said passage hole, wherein said second engaging wedge side correspondingly faces said first engaging wedge side without contacting said hole edge of said passage hole, whereby when said latch assembly is reversely assembled in coordination with a door panel of different open direction, said second locating pin is allowed to pass through said engaging hole and said second engaging wedge side contacts said hole edge of said engaging hole to link and drive said assembly body to withdraw, so as to allow said face member to lean against the lateral side of the door panel.

4. The lock, as recited in claim 3, wherein said first locking mechanism further comprises a hollow exterior housing, sleeved on an outer side of said locating ring, wherein said linkage member has a core locking portion assembled in said locating ring and a stem extended from said core locking portion, wherein said stem passes through said core lock hole of said latch assembly and is connected with said turning member, wherein said stem has a gap formed from said core lock hole.

5. The lock, as recited in claim 4, wherein said assembly body further has two perforations formed therein, wherein said second locking mechanism further comprises a mounting member arranged in said second locating barrel and a cover covering on said second locating barrel, wherein said mounting member comprises a disk arranged in said second locating barrel and two mounting rods parallelly extended from said disk correspondingly passing through said perforations of said assembly body, wherein said turning member comprises a knob and a shank extended from said knob to pass through said cover, said second locating barrel and said disk and connected with said stem.

6. The lock, as recited in claim 5, wherein said first locating barrel has a base plate for being contacted and attached with the first surface of the door panel, and an upper barrel piece and a lower barrel piece respectively extended from said base plate toward the assembling hole, wherein said upper barrel piece and said lower barrel piece define a space therebetween for said assembly body to lateral pass through and be accommodated therein, wherein said upper barrel piece and said lower barrel piece allow said second locating barrel to be screw connected and positioned.

* * * * *